US009895621B1

(12) United States Patent
Bradley

(10) Patent No.: US 9,895,621 B1
(45) Date of Patent: Feb. 20, 2018

(54) MULTI-DIRECTIONAL REACTIVE PENDULUM OBJECT

(71) Applicant: Keith Aaron Bradley, Janesville, WI (US)

(72) Inventor: Keith Aaron Bradley, Janesville, WI (US)

( * ) Notice: Subject to any disclaimer, the term of this patent is extended or adjusted under 35 U.S.C. 154(b) by 54 days.

(21) Appl. No.: 14/594,162

(22) Filed: Jan. 11, 2015

(51) Int. Cl.
*A63H 13/18* (2006.01)
*A63H 15/06* (2006.01)

(52) U.S. Cl.
CPC ..... *A63H 15/06* (2013.01)

(58) Field of Classification Search
CPC ..... A63H 13/18
USPC ..... 446/396
See application file for complete search history.

(56) References Cited

U.S. PATENT DOCUMENTS 15,072 A * 6/1856 Ford et al. ..... F41A 3/06 42/27
376,588 A * 1/1888 Fallis ..... A63H 15/02 446/316
1,041,677 A * 10/1912 Sadtler ..... A63H 18/028 172/26
1,897,670 A * 2/1933 Melville ..... A63H 13/00 446/353
D144,098 S * 3/1946 Bunnell ..... D21/590
2,962,830 A * 12/1960 Ryan ..... F41C 3/08 42/57
3,002,335 A * 10/1961 Kripak ..... G04B 29/00 368/220
D216,999 S * 3/1970 Kanbar ..... 434/302
3,977,085 A * 8/1976 Sandifer ..... B43L 11/005 33/27.11
3,995,788 A * 12/1976 Stephenson ..... B60R 22/40 242/384.4
4,341,035 A * 7/1982 Jaworski ..... A63H 33/22 40/587
4,560,363 A * 12/1985 Garza ..... A63H 3/40 446/342
5,052,970 A * 10/1991 Balwigaire ..... A63H 15/04 446/322
5,732,493 A * 3/1998 Luedtke ..... G09F 19/02 40/411
5,842,902 A * 12/1998 Liff ..... A63H 33/26 446/130
6,074,269 A * 6/2000 Rothbarth ..... A63F 7/3622 238/10 R
6,511,360 B1 * 1/2003 Lyman ..... A63H 15/04 40/485

(Continued)

*Primary Examiner* — John E Simms, Jr.
*Assistant Examiner* — Dolores Collins
(74) *Attorney, Agent, or Firm* — Charles S. Sara; DeWitt Ross & Stevens S.C.

(57) ABSTRACT

The invention is a multi-directional reactive pendulum object that is intended to be attached to any moving object such as the dashboard of a motor vehicle. The object is put into motion by the movement of the vehicle causing a pendulum to swing. The pendulum operates two levers that are on pivots which are perpendicular to each other. The object entertains occupants by mimicking the actions of the movement of the vehicle (i.e. turning left, right, stopping, accelerating). Placed on top of the pendulum object will be a toy consisting of various characters, models, or artistic renderings of existing items such as a car, motorcycle, or airplane.

9 Claims, 12 Drawing Sheets

(56) References Cited

U.S. PATENT DOCUMENTS

| | | | | |
|---|---|---|---|---|
| 7,900,584 | B2 * | 3/2011 | Suring | A01K 15/025 119/702 |
| 8,269,447 | B2 * | 9/2012 | Smoot | B62K 1/00 180/24.01 |
| 8,371,249 | B1 * | 2/2013 | Little | A01K 15/025 119/707 |
| 8,414,350 | B2 * | 4/2013 | Rehkemper | A63H 11/20 446/330 |
| 8,550,927 | B2 * | 10/2013 | Hunter-Jones | A47D 13/105 472/119 |
| 8,894,463 | B2 * | 11/2014 | Chan | 446/268 |
| 2007/0295284 | A1 * | 12/2007 | Suring | A01K 15/025 119/708 |
| 2010/0221692 | A1 * | 9/2010 | Lally | G09B 23/08 434/302 |

* cited by examiner

MULTI-DIRECTIONAL REACTIVE PENDULUM OBJECT

CROSS-REFERENCE TO RELATED APPLICATIONS

Not Applicable.

STATEMENT REGARDING FEDERALLY SPONSORED RESEARCH OR DEVELOPMENT

Not Applicable.

FIELD OF THE INVENTION

The present invention relates to an object that is activated by the movement of a pendulum. The invention is meant to be mounted/attached to a moving object which causes the pendulum to swing. The pendulum rod extends above the pendulum pivot and activates two levers. The lower lever moves the toy left and right on a fixed axis. The upper lever moves the toy forward and backwards on a fixed axis. Both upper and lower levers are able to be moved at the same time.

BACKGROUND OF THE INVENTION

Novelty items such as vehicle accessories and gadgets have always been a fascinating way for owner/operators to express their hobbies and beliefs. The multi-directional reactive pendulum object also allows the occupants to be entertained by the mirrored and exaggerated actions of the device as it is moved.

BRIEF SUMMARY OF THE INVENTION

The multi-directional reactive pendulum object is meant to be placed on any moving vehicle, i.e. the dashboard of an automobile, boat, train, plane, golf cart. The toy at the top of the pendulum object will mimic the movement of the vehicle that it is placed upon. The movement of the toy is caused by a pendulum rod with bob attached that transfers movement to two perpendicular pivots that can be operated at the same time. When the vehicle corners, the bob will swing from the lateral force. This motion is transferred to the left/right pivot via the pendulum rod pivot connection point which allows forward/backward movement of the pendulum rod while transferring left to right movement directly to the lower lever. Said lower lever left/right pivot is located above the pendulum bob causing the upper lever's movement to be opposite of the bobs, creating the effect that the toy is leaning into the corner. When the vehicle accelerates, the bob will swing backwards; when the vehicle decelerates, the bob will swing forward. These movements are transferred to contact tabs on the toy which are located below said toy's forward/backward pivot by a portion of the pendulum rod that extends past said pendulum rod pivot causing the movement to again be reversed giving the effect that the toy is doing a wheelie when accelerating and a nose dive when decelerating. Both pivots can move at the same time, e.g. if the vehicle is accelerating and turning, the toy will wheelie and lean into the turn simultaneously.

BRIEF DESCRIPTION OF THE DRAWINGS

The drawings in this application illustrate the interaction of the components.

DETAILED DESCRIPTION OF THE INVENTION

Figure 1:
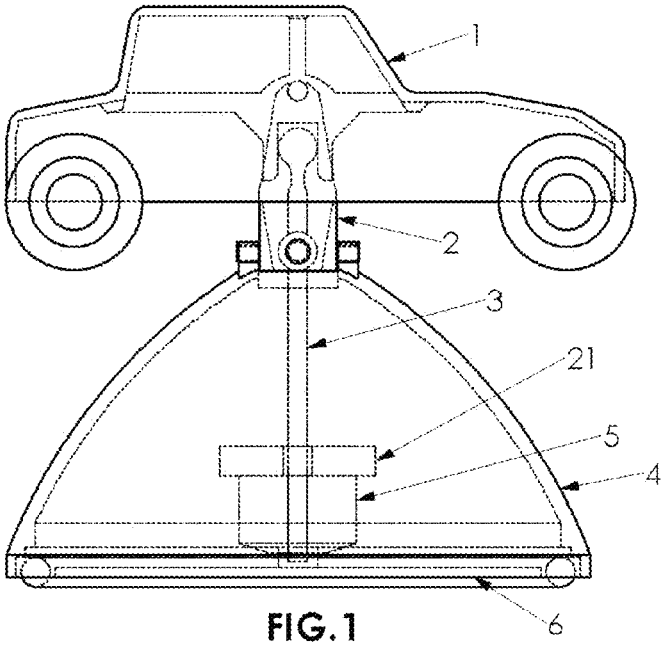
FIG. 1 shows the right side of the multi-directional reactive pendulum object with hidden lines when not in motion in the preferred embodiment.
Figure 1A:
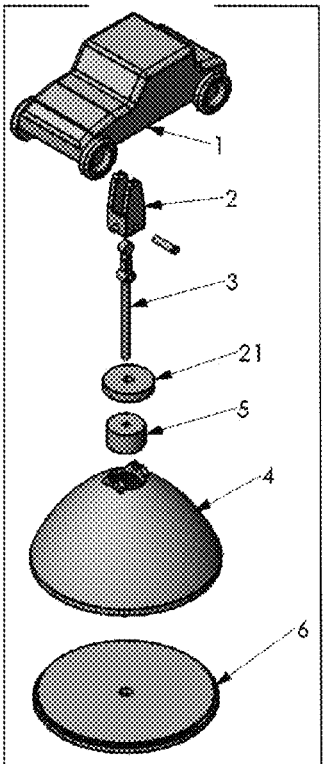
FIG. 1A shows a shaded isometric exploded view from the top left of the multi-directional reactive pendulum object and when not in motion in the preferred embodiment.
Figure 2:
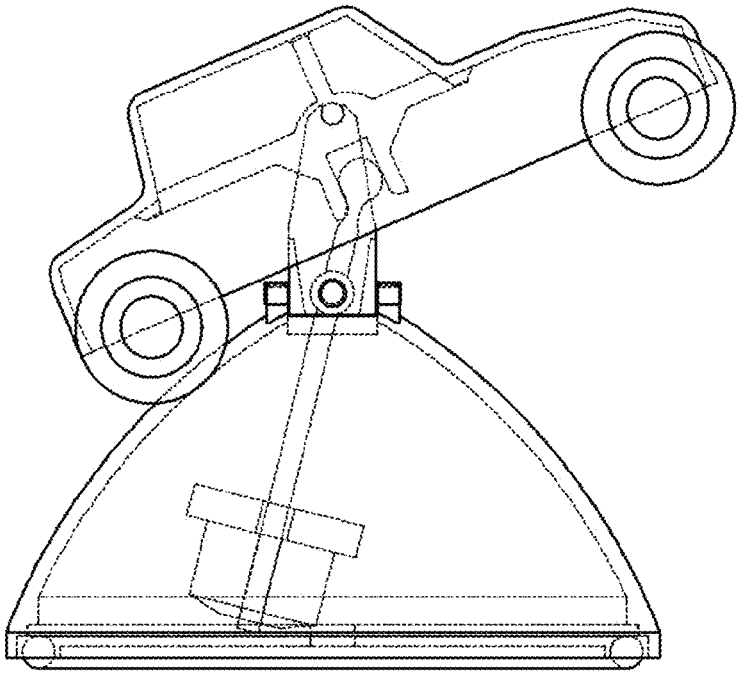
FIG. 2 shows the right side of the multi-directional reactive pendulum object with hidden lines and when exposed to acceleration in the preferred embodiment.
Figure 3:
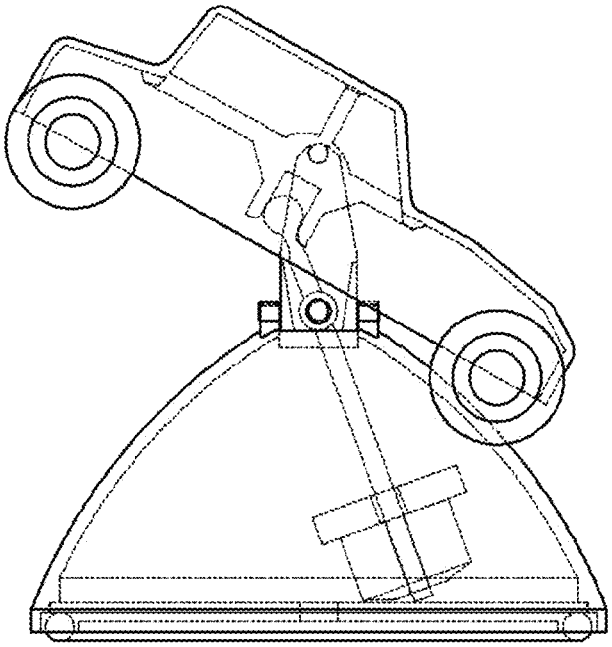
FIG. 3 shows the right side of the multi-directional reactive pendulum object with hidden lines when exposed to deceleration in the preferred embodiment.
Figure 4:
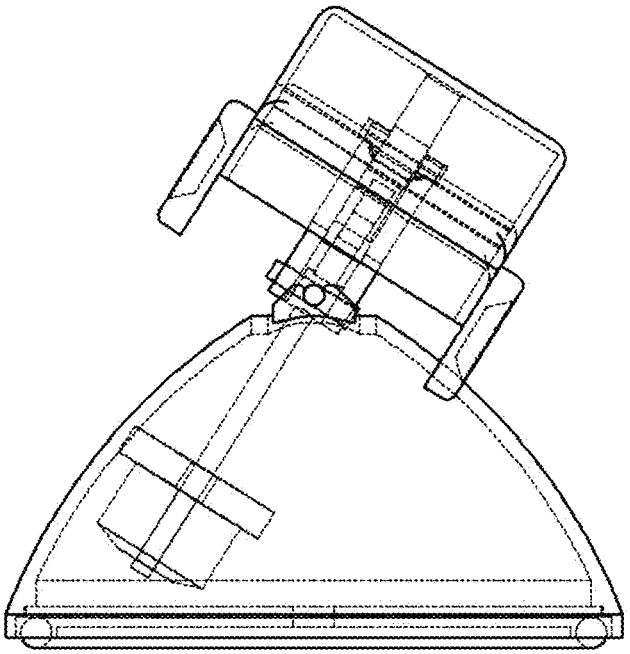
FIG. 4 shows the multi-directional reactive pendulum object from behind with hidden lines and when mounted to a vehicle that is turning right in the preferred embodiment.
Figure 5:
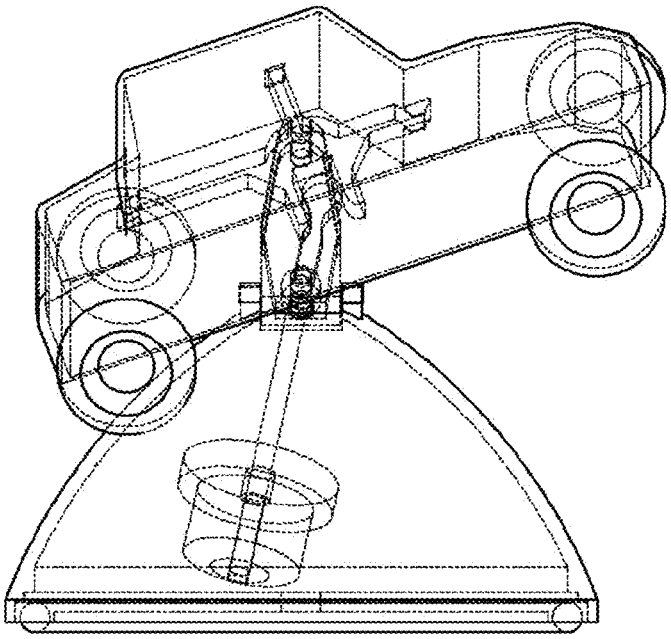
FIG. 5 shows the right side of the multi-directional reactive pendulum object with hidden lines when turning right and accelerating in the preferred embodiment.
Figure 5A:
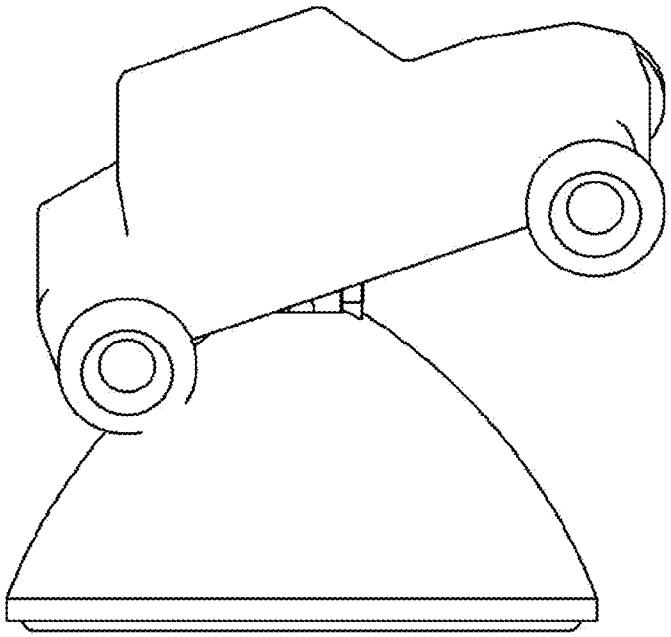
FIG. 5A shows the right side of the multi-directional reactive pendulum object when turning right and accelerating in the preferred embodiment.
Figure 6:
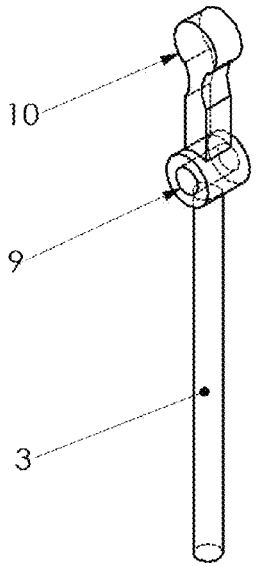
FIG. 6 shows the pendulum rod features in a wire frame isometric view in the preferred embodiment.
Figure 7:
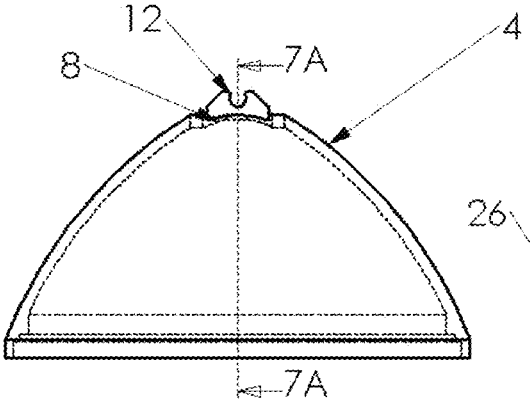
FIG. 7 shows the base components with hidden lines in the preferred embodiment.
Figure 7A:
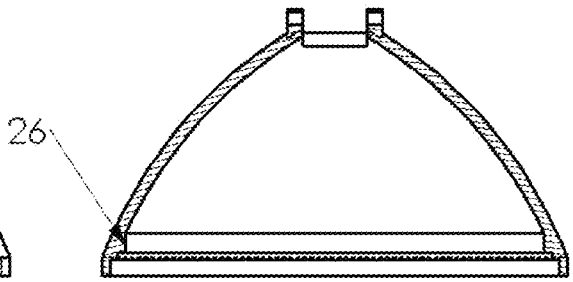
FIG. 7A shows a cross section of the base with hidden lines in the preferred embodiment.
Figure 8:
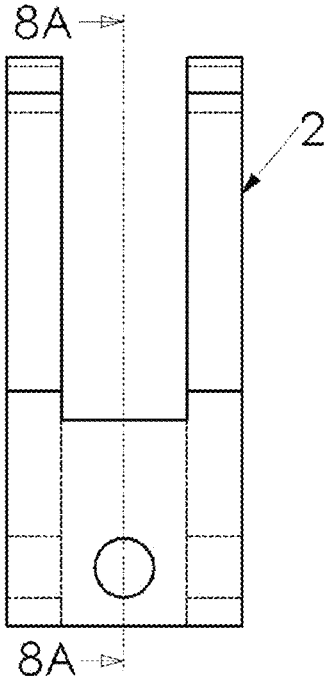
FIG. 8 shows the lower lever with hidden lines in the preferred embodiment.
Figure 8A:
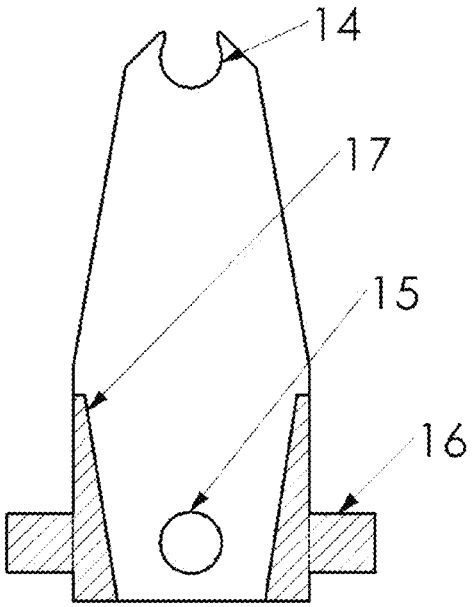
FIG. 8A shows a cross section of the lower lever features in the preferred embodiment.
Figure 9:
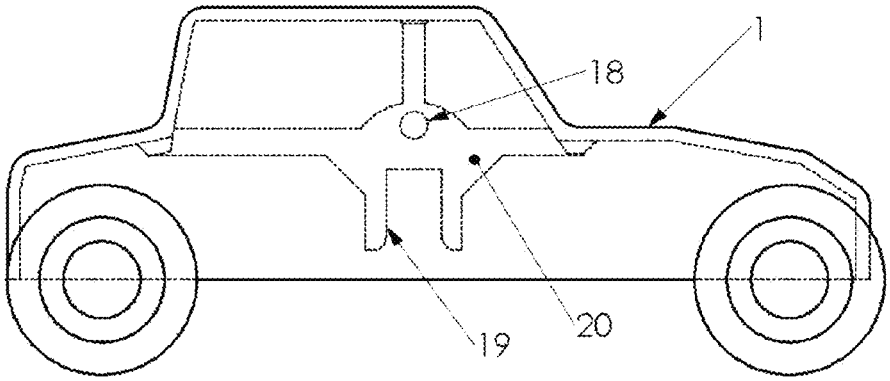
FIG. 9 shows the right side of the toy's features with hidden lines in the preferred embodiment.

The multi-directional reactive pendulum object has a bob (5) that is attached to the bottom of a rigid pendulum rod (3). The bob (5) is round and has a pendulum rod mounting hole (7) through the center allowing the pendulum rod (3) to be attached to it. The bob (5) also has a chamfered bottom edge (11) to allow clearance of the base cap (6) when swinging. The bob (5) is made of high density material such as lead, steel, or other metals and is attached to the pendulum rod (3) with adhesive, mechanical fasteners, resistance fit or by upsetting the end of the pendulum rod (3) with heat or pressure.

The pendulum rod (3) is composed of two main parts: the pivot (9) and the upper pendulum rod extension (10). The pendulum rod (3) can be made of injection molded rigid plastic, nylon, PVC or other lightweight rigid material or metal.

The pivot (9) is the axis that the pendulum swings forward and backwards on and is also the contact point that transfers left and right movement of the pendulum to the lower lever (2). The pivot (9) is sized in a manor that allows the fastener that it swings on to slip through allowing it to swing freely with minimal resistance.

The upper pendulum rod extension (10) transfers the pendulum's forward and backward movement to the toy (1). The upper pendulum rod extension (10) extends above the pivot (9) and has a bulb shape at the end to allow for continuous contact with the toy (1) contact tabs (19) as the parts move.

The bob bumper (21) is shaped like a disc, is slightly larger in diameter than the bob (5), and has a bumper hole (24) in the center of it allowing it to fit freely over the pendulum rod (3) and rest on the bob (5). The pendulum bob bumper (21) is made of a soft resilient material such as low density open-celled foam.

The base (4) is shaped like a dome and is made of injection molded rigid plastic, nylon, PVC or other lightweight rigid material. The exterior of the base (4) can be smooth to simulate air, concrete, or asphalt. The exterior of the base (4) can also be rough to simulate dirt, rocks, or waves. The base (4) can be injection molded with colored material or painted to further simulate the above stated exterior surface conditions. The base (4) can have wheels (27) attached or molded as part of it further enhancing the realistic characterization of the toy (1) mounted on top. The base (4) is hollow with thin walls and consists of three main parts: the lower lever mounting cradle (12) which is the receptacle for the lower lever (2), the pendulum rod clearance hole (8), and the recessed cap receptacle (26). The lower lever mounting cradle (12) allows the lower lever pivot trunions (16) to be attached to the base (4) with a firm snap fit due to a slightly closed "C" shape design with the opening at the top of the lower lever mounting cradle (12) being slightly narrower than the lower lever pivot trunions (16). This allows for simple assembly and reduced costs. The inside surfaces of the lower lever mounting cradle (12) are smooth to reduce friction. The bottom of the base (4) has a recessed cap receptacle (26) to allow for the concealed fitment of the base cap (6). The recessed cap receptacle (26) can have a small lip that will allow the base cap (6) to be snapped into place.

The base cap (6) is made of injection molded rigid plastic, nylon, PVC or other lightweight rigid material. There can be a fastener hole (41) in the middle to allow a mechanical fastener to be used to mount it to the vehicle. The base cap (6) has a flat bottom to allow the placement of adhesive tape for fastening to the vehicle and/or can have a ring of soft rubber (42) around the edge to dampen vibration transferred from the vehicle. Said ring of soft rubber (42) will consist of a resilient material such as polyurethane gel or silicone rubber and can be fitted to a channel within the cap, secured with adhesives, or the cap could be a dual durometer injection molded part.

The lower lever (2) is made of injection molded rigid plastic, nylon, PVC, or other lightweight rigid material. The lower lever (2) is slightly narrower than the gap between the base's (4) lower lever mounting cradle (12) allowing for free movement. The lower lever (2) consists of four main parts: the toy mounting cradle (14), the pendulum pivot (15), the lower lever pivot trunions (18) and the pendulum rod bumpers (17). The toy mounting cradle (14) is the receptacle for the toy (1). It allows the toy's (1) pivot trunions (18) to be attached to the lower lever (2) with a firm snap fit due to a slightly closed "C" shape design. The opening at the top of the upper lever mounting cradle (14) is slightly narrower than the toy's (1) pivot trunions (18). This allows for simple assembly and reduced costs. The inside surfaces of the toy mounting cradle (14) are smooth to reduce friction. The lower lever pivot trunions (16) are the pivot point for the lower lever (2) and allow the lower lever (2) to move left and right. The lower lever pivot trunions (16) are smooth plastic and slightly smaller than the lower lever mounting cradle (12) to allow for easy movement due to reduced friction. The toy pivot trunions (18) snap firmly into the base's (4) lower lever mounting cradle (12). The pendulum pivot (9) is the receptacle where the pendulum rod is mated. The pendulum rod (3) is passed through the middle of the lower lever (2), and a fastener is inserted through the pendulum pivot (15) and the pivot (9). The pendulum rod bumpers (17) limit the forward and backward movement of the pendulum rod (3).

The toy (1) is thin walled and light weight made of injection molded rigid plastic, nylon, PVC, or other lightweight rigid material. The toy (1) consists of three main parts: the toy pivot trunions (18), the contact tabs (19) and the mounting surface (20). The toy pivot trunions (18) are smooth plastic and slightly smaller than the upper lever mounting cradle (14) to allow for easy movement due to reduced friction. The toy mounting surface (20) is also slightly narrower than the gap between the toy mounting cradles (14) to allow for free movement. The toy pivot trunions (18) snap firmly into the toy mounting cradle (14) due to a slightly closed "C" shape design. The toy contact tabs (19) are two tabs that project downward and capture the upper pendulum rod extension (10). The toy contact tabs (19) are located below the toy pivot trunions (18) which allow the movement of the upper pendulum rod extension (10) to be reversed when transferred to the toy (1). The toy (1) can be various characters, models, or artistic renderings of existing items such as a car, motorcycle, airplane, animal or person.

Figure 10:
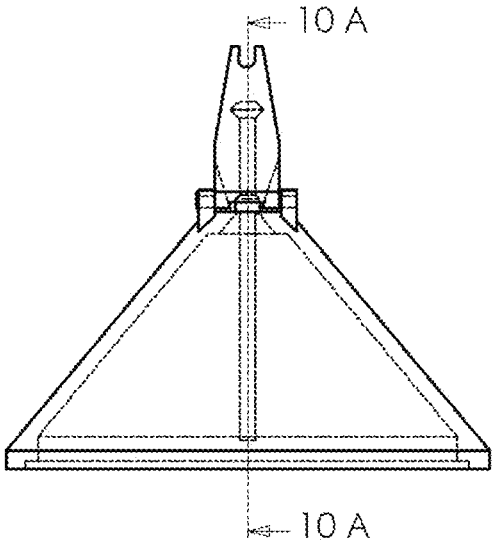
FIG. 10 shows a second embodiment in wire frame of the pendulum pivot ledge and base pivot shelf.
Figure 10A:
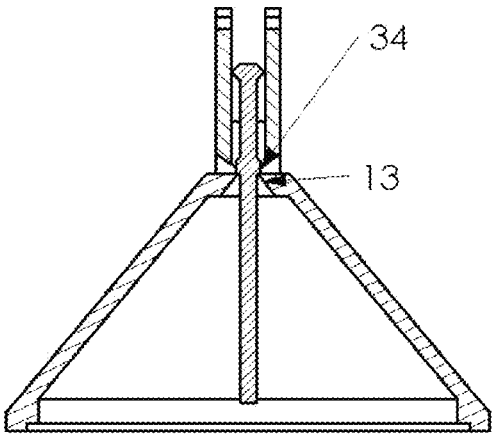
FIG. 10A shows a second embodiment in cross section view with hatching of the pendulum pivot ledge and base pivot shelf.

FIG. 10 shows a second embodiment of the pivot (9) that was described in the preferred embodiment and achieves the same desired final function as the preferred embodiment. This drawing shows the pivot (9) replaced by the pivot ledge (34) and pivot shelf (13).

Figure 11:
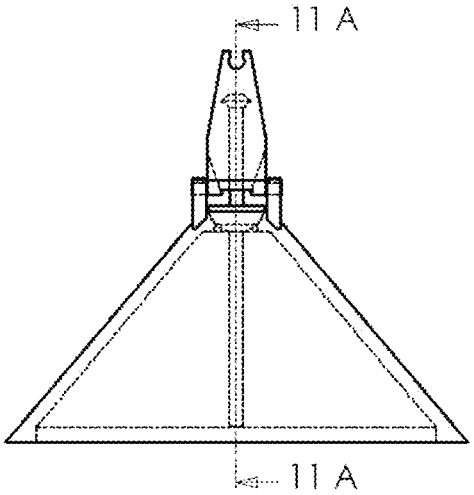
FIG. 11 shows a second embodiment in wire frame of the pendulum ball and base socket.
Figure 11A:
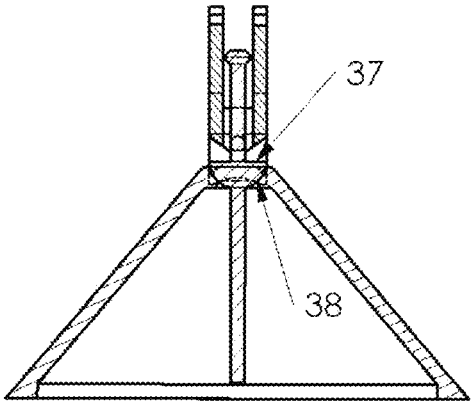
FIG. 11A shows a second embodiment in cross section view with hatching of the pendulum ball and base socket.

FIG. 11 shows a second embodiment of the pivot (9) that was described in the preferred embodiment and achieves the same desired final function as the preferred embodiment. This drawing shows the pivot (9) replaced by the pivot ball (37) and pivot socket (38).

Figure 12:
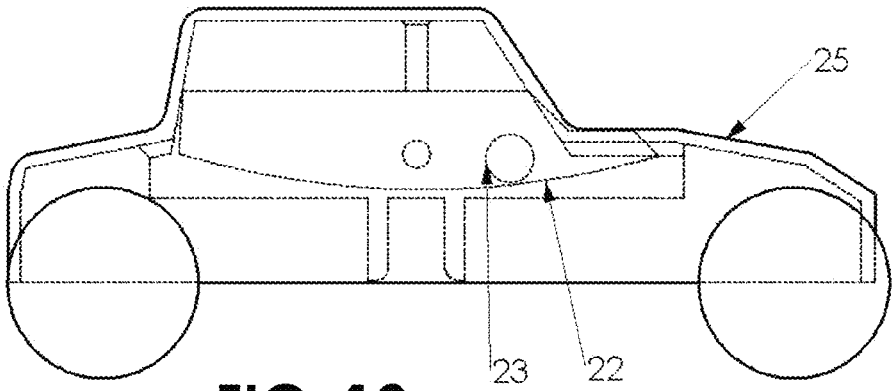
FIG. 12 shows a second embodiment where the toy has a ball that is captured in a channel.

FIGS. 12 and 12A show a second embodiment of the toy (1) as described in the preferred embodiment and achieve the same desired final function as the preferred embodiment, but enhances the forward and backward movement of the toy (1). The channeled toy (25) has a channel (22) running front to back with a roller (23) that is placed within it. Said roller (22) is round or cylindrical and made of steel or dense material that is able to roll forward and backward within said channel (22). The channel (22) is bowed downward to allow the roller (23) to return to the center/balanced position when the object is at rest. Said roller (23) assists the forward and backward tilt of the toy (1) by moving forward and backward from inertia with assistance by the movement of the pendulum rod (3).

Figure 13:
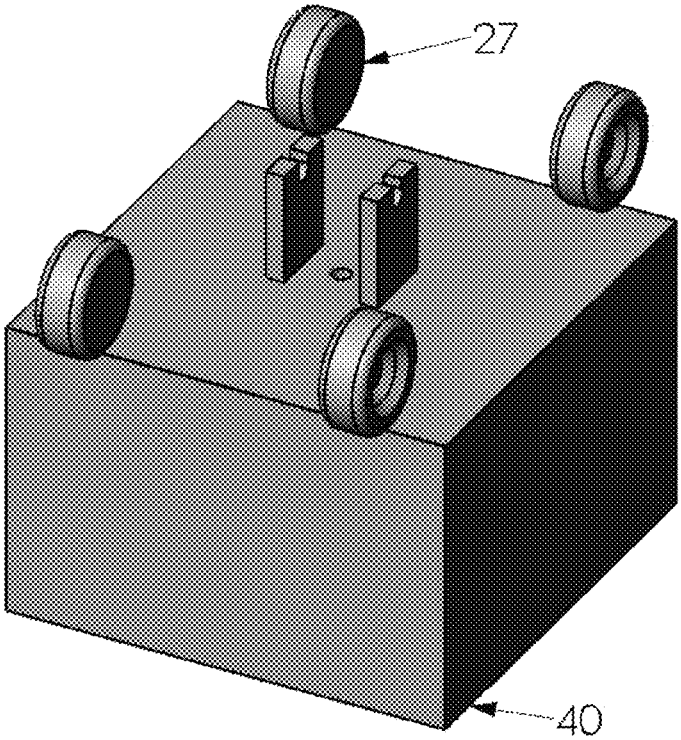
FIG. 13 shows a second embodiment of the base having wheels attached to it.

FIG. 13 shows a second embodiment of the base (4) as described in the preferred embodiment and achieves the same desired final function as the preferred embodiment. This drawing shows a box shaped base (40) with wheels (27) being molded or added to it.

Figure 14:
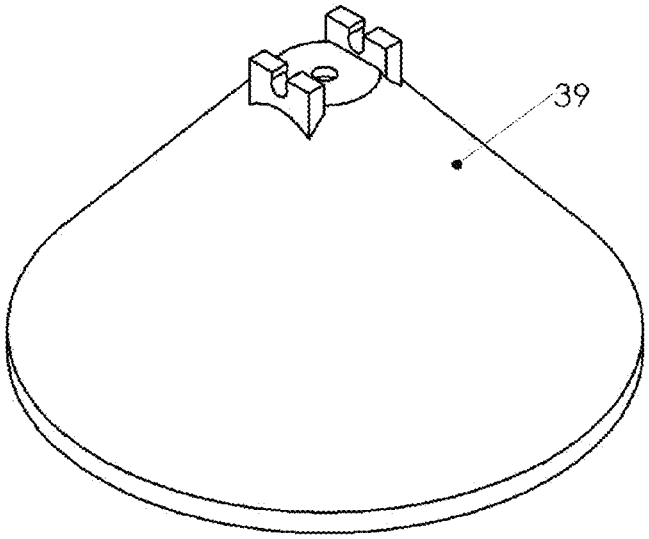
FIG. 14 shows a second embodiment of the base consisting of a cone.

FIG. 14 shows a second embodiment of the base (4) as described in the preferred embodiment and achieves the same desired final function as the preferred embodiment. This drawing shows the base shaped as a cone (39) allowing the toy (1) greater range of movement without contacting said cone (39).

Figure 15:
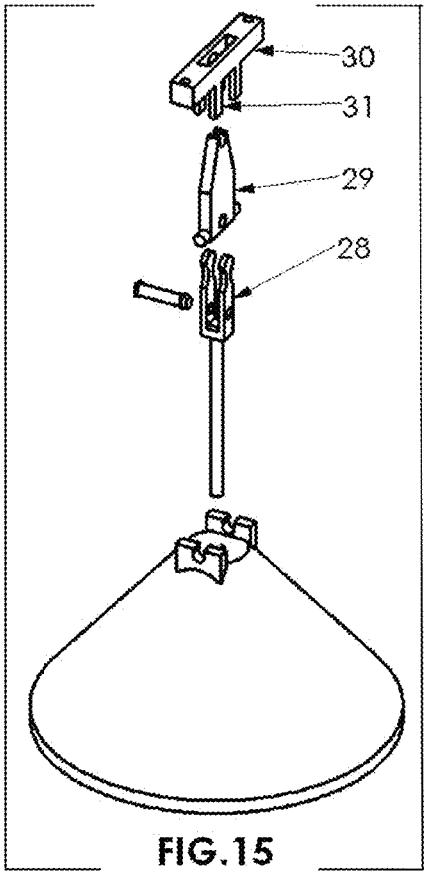
FIG. 15 shows a second embodiment of the multi-directional reactive pendulum object where the upper pendulum extension is forked and goes on the left and right side of the lower lever. The lower lever consists of a single leg into which the upper lever mounts.

FIG. 15 shows a second embodiment of the multi-directional reactive pendulum object as described in the preferred embodiment and achieves the same desired final function as the preferred embodiment. The upper pendulum rod extension (10) as described in the preferred embodiment is replaced by the pronged upper rod (28) and has two prongs that extend upward on each side of the narrow lower lever (29) that replaces the lower lever (2) which is described in the preferred embodiment. The split mounting surface (30) replaces the mounting surface (20), and contact tabs (19) are replaced with quad legs (31) that extend down and are operated by the pronged upper rod (28).

Figure 16:
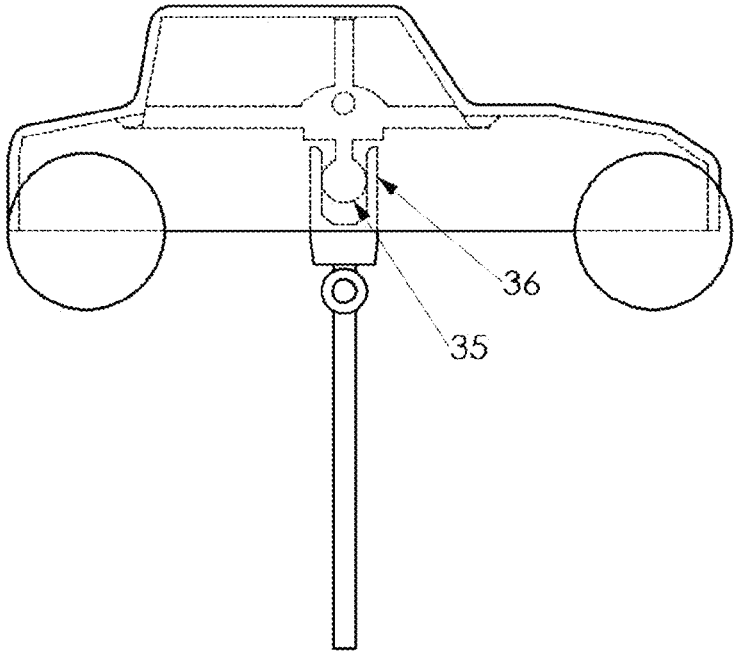
FIG. 16 shows a second embodiment of the multi-directional reactive pendulum object where the upper rod extension is forked and captures a tab on the toy.

FIG. 16 shows a second embodiment of the multi-directional reactive pendulum object and achieves the same desired final function as the preferred embodiment. The upper pendulum rod extension (10) is replaced by the shown upper rod fork (36). The contact tabs (19) are replaced by the shown single contact tab (35). The single contact tab (35) is round to allow for continuous contact with said upper rod fork (36).

Figure 17:
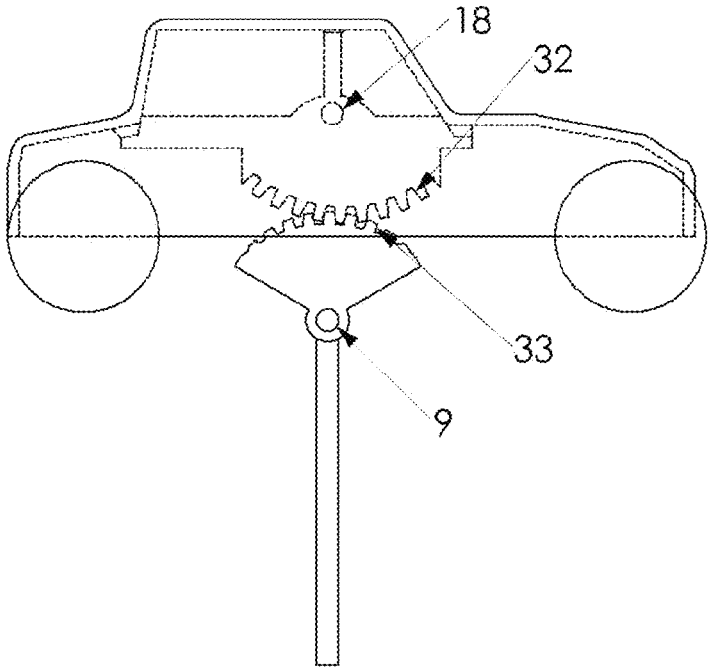
FIG. 17 shows a second embodiment with hidden lines where the pendulum rod upper extension is a gear and the toy is operated with a gear.
Figure 18A:
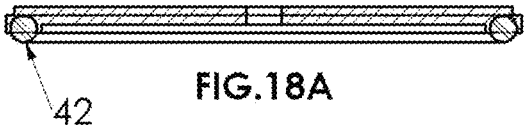
FIG. 18A shows a cross section view of the base cap and features with soft rubber ring molded into it.
Figure 18:
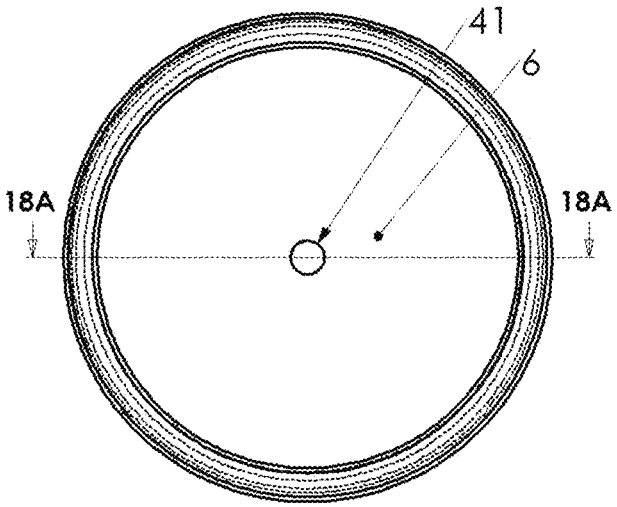
FIG. 18 shows a top view of the base cap and features with soft rubber ring molded into it.
Figure 19:
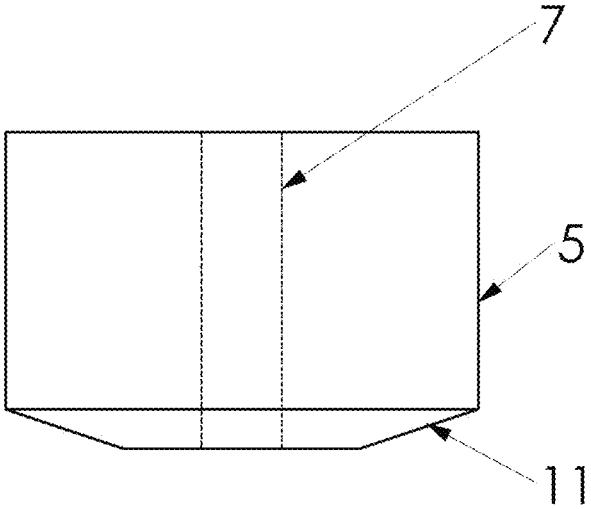
FIG. 19 shows the bob features with hidden lines in the preferred embodiment.
Figure 20:
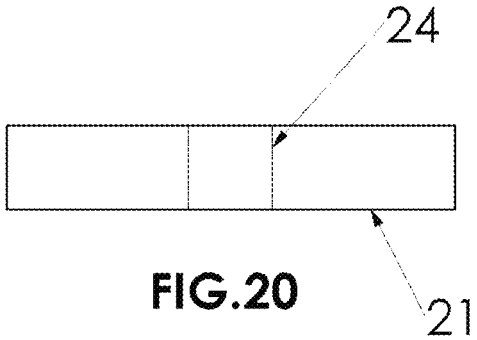
FIG. 20 shows the bob bumper components with hidden lines in the preferred embodiment.

FIG. 17 shows a second embodiment of the multi-directional reactive pendulum object and achieves the same desired final function as the preferred embodiment where said toy contact tabs (19) are replaced with a cogged semi-circle (32) that is centered on the toy pivot trunions (18) and said pendulum rod extension (10) is replaced by a cogged extension (33) that is centered on the pivot (9).

Figure 21:
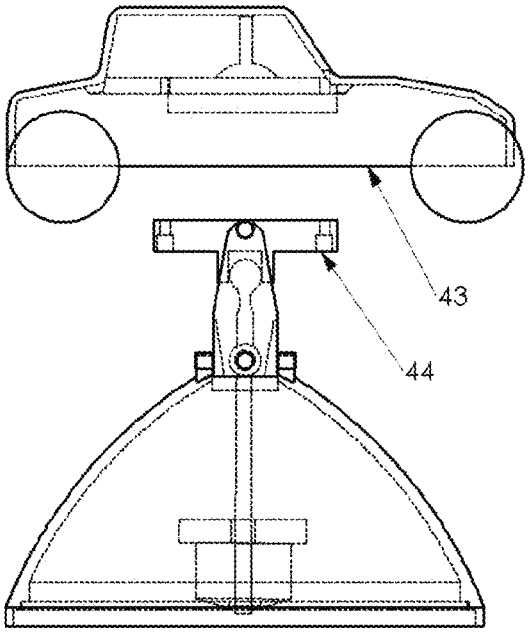
FIG. 21 shows a second embodiment in a partially exploded view with hidden lines where the toy is a shell that attaches to a separate lower lever that contains the pivot points and contact tab.

FIG. 21 shows a second embodiment of the multi-directional reactive pendulum object and achieves the same desired final function as the preferred embodiment. FIG. 21 shows said toy (1) comprised of two separate parts: a toy shell (43) and an upper lever (44). The two items will be assembled using adhesive, mechanical fasteners or resistance fit pins that are molded into the toy shell (43).

Assembly (Preferred Embodiment)

The bob bumper slides over the pendulum rod. The bottom of the pendulum rod is then inserted through the pendulum bob, and a fastener or adhesive is applied, or the end of the pendulum rod can be upset with heat or pressure to prevent the bob from being removed. The pendulum rod is inserted through the hole between the mounting cradles on the base from below. The lower lever is snapped into the base, and a fastener is passed through the lower lever and pendulum. The toy is snapped onto the lower lever. The base cap is snapped onto the base, attached with mechanical fasteners or adhesive.

Function (Preferred Embodiment)

The multi-directional reactive pendulum object is meant to be placed on any moving vehicle, i.e. the dashboard of an automobile, boat, train, plane, golf cart. The toy at the top of the pendulum object will mimic the movement of the vehicle that it is placed upon. The movement of the toy is created by a pendulum rod with bob attached that transfers movement to two perpendicular pivots that can be operated at the same time. When the vehicle corners, the bob will swing from the lateral force. This motion is transferred to the left/right pivot by means of the pendulum rod which is on its own pivot that allows free forward/backward movement while transferring left to right movement directly to the lower lever. Said lower lever right/left pivot is located above the pendulum bob causing the upper lever's movement to be opposite of the bobs, creating the effect that the toy is leaning into the corner. When the vehicle accelerates, the bob will swing backwards; when the vehicle decelerates, the bob will swing forward. This movement is transferred to contact tabs on the toy which are located below the said toy's forward/backward pivot by a portion of the pendulum rod that extends past the said pendulum rod pivot causing the movement to be again reversed giving the effect that the toy is doing a wheelie when accelerating and a nose dive when decelerating. Both pivots are able to move at the same time, e.g. if the vehicle is accelerating and turning, the toy will wheelie and lean into the turn. The greater the force exerted on the bob the further the toy will move. There is a bob bumper added to the top of the bob to prevent the bob from contacting the base when the multi-directional reactive pendulum object is exposed to sudden movement such as the vehicle hitting a severe bump. The toy or character will cover and conceal the lever to give the entire device a clean appearance.

The invention claimed is:

1. A multidirectional reactive pendulum device that emulates the motion of a moving object, the device including:

a. a base having a base mounting cradle;

b. a pendulum rod that is partly inserted in the base, the pendulum rod having a rod upper extension extending from a pivot connection point;

c. a lower lever through which the rod upper extension is received, the lower lever:

i. being secured to the pendulum rod via the pivot connection point; and ii. pivotably interfacing with the base mounting cradle such that the pendulum rod is pivotable along a first axis with respect to the base; and d. a toy that is rotatably interfaced with the rod upper extension such that the toy is pivotable along a second axis with respect to the lower lever, the second axis being different from the first axis, wherein the toy is simultaneously pivotable along both the first and second axes, wherein the toy includes at least two downwardly-projecting contact tabs that fit about at least a portion of the rod upper extension.

2. The device of claim 1 wherein the lower lever includes lower lever pivot trunions that snap fit with the base mounting cradle to secure the lower lever to the base.

3. The device of claim 2 wherein the lower lever pivot trunions:

a. are a pivot point for the lower lever; and b. allow the lower lever to move leftward and rightward.

4. The device of claim 1 further including a fastener, wherein:

a. the pivot connection point includes an aperture extending thereto; and b. the lower lever further includes a pendulum pivot;

c. the fastener is inserted through the pendulum pivot and the pivot connection point to mate the pendulum rod to the pivot connection point.

5. The device of claim 1 wherein the lower lever includes pendulum rod bumpers that limit the range of forward and backward movement of the pendulum rod.

6. The device of claim 1 wherein:

a. the lower lever includes a toy mounting cradle; and b. the toy includes toy pivot trunions that snap fit with the toy mounting cradle to secure the toy to the lower lever.

7. The device of claim 6 wherein inside surfaces of the toy mounting cradle are substantially smooth to reduce friction with the toy pivot trunions.

8. The device of claim 1 wherein:

a. the lower lever includes a toy mounting cradle; and b. the toy includes pivot trunions that snap fit with the toy mounting cradle to secure the lower lever to the toy.

9. The device of claim 1 wherein:

a. the pendulum rod pivots along the first axis to move the toy in leftward and rightward directions; and b. the toy pivots along the second axis to move the toy in forward and backward directions.

* * * * *